US011661262B2

(12) United States Patent
Kuhn et al.

(10) Patent No.: US 11,661,262 B2
(45) Date of Patent: May 30, 2023

(54) THERMAL-INSULATION CONTAINER

(71) Applicant: va-Q-tec AG, Würzburg (DE)

(72) Inventors: Joachim Kuhn, Würzburg (DE); Sebastian Satzinger, Iphofen (DE); Thomas Taraschewski, Würzburg (DE)

(73) Assignee: va-Q-tec AG, Wurzburg (DE)

( * ) Notice: Subject to any disclaimer, the term of this patent is extended or adjusted under 35 U.S.C. 154(b) by 0 days.

(21) Appl. No.: 17/032,782

(22) Filed: Sep. 25, 2020

(65) Prior Publication Data

US 2021/0094750 A1 Apr. 1, 2021

(51) Int. Cl.
*B65D 81/38* (2006.01)

(52) U.S. Cl.
CPC ..... *B65D 81/3823* (2013.01); *B65D 81/3816* (2013.01)

(58) Field of Classification Search
CPC ..... B65D 81/3823; B65D 81/3816; B65D 81/3862; B65D 81/38; Y10S 220/903; Y10S 977/832
USPC ..... 220/592.2, 592.25, 592.26; 428/35, 35.7
See application file for complete search history.

(56) References Cited

U.S. PATENT DOCUMENTS

| | | | | |
|---|---|---|---|---|
| 5,235,819 | A | 8/1993 | Bruce | |
| 5,798,154 | A * | 8/1998 | Bryan | E04B 1/803 428/35.3 |
| 6,029,457 | A * | 2/2000 | Neeser | A47J 36/2494 220/901 |
| 6,230,500 | B1 * | 5/2001 | Mao | F17C 3/04 62/45.1 |
| 7,584,863 | B2 * | 9/2009 | Bucher | B65D 88/121 220/1.5 |
| 10,562,695 | B2 * | 2/2020 | Knight | F25D 3/08 |

(Continued)

FOREIGN PATENT DOCUMENTS

| | | | |
|---|---|---|---|
| DE | 102004053113 | A1 | 5/2006 |
| EP | 0157751 | A2 | 10/1985 |

(Continued)

*Primary Examiner* — J. Gregory Pickett
*Assistant Examiner* — Niki M Eloshway
(74) *Attorney, Agent, or Firm* — Mark Terry

(57) ABSTRACT

Thermal-insulation container 1, comprising a bottom 26, side walls 21, 22, 23, 24 arranged on the bottom 26 and a lid 25 arranged on the side walls 21, 22, 23, 24, wherein the bottom 26, the side walls 21, 22, 23, 24 and the lid 25 completely enclose an interior space 3, and wherein the lid 25 has a heat transfer coefficient $k_D$, the bottom 26 has a heat transfer coefficient $k_B$, and each of the side walls 21, 22, 23, 24 has one of the heat transfer coefficients $k_{S1}$, $k_{S2}$, $k_{S3}$ or $k_{S4}$, and further $k_D$<minimum [$k_{S1}$, $k_{S2}$, $k_{S3}$, $k_{S4}$, $k_B$].

7 Claims, 1 Drawing Sheet

(56) References Cited

U.S. PATENT DOCUMENTS

| | | | | |
|---|---|---|---|---|
| 2002/0130131 | A1* | 9/2002 | Zucker | F17C 13/001 220/592.2 |
| 2011/0147391 | A1* | 6/2011 | Corder | B65D 81/3823 220/592.27 |
| 2012/0156002 | A1* | 6/2012 | Maruhashi | B65D 81/3816 414/800 |
| 2014/0353317 | A1* | 12/2014 | Ranade | B65D 81/3823 220/592.01 |
| 2015/0284169 | A1* | 10/2015 | Nehring | B65D 81/18 220/592.25 |
| 2016/0272405 | A1* | 9/2016 | Furneaux | B65D 25/38 |
| 2017/0370632 | A1* | 12/2017 | Jeong | F25D 23/065 |
| 2018/0031304 | A1* | 2/2018 | Kal | B32B 17/02 |
| 2018/0224178 | A1* | 8/2018 | Sun | B65D 81/3823 |
| 2019/0144193 | A1* | 5/2019 | Kim | B65D 81/3818 220/592.2 |
| 2019/0241350 | A1 | 8/2019 | Goellner | |

FOREIGN PATENT DOCUMENTS

| | | | |
|---|---|---|---|
| JP | 61501700 | A | 8/1986 |
| JP | 0487792 | U | 7/1992 |
| JP | H06156551 | A | 6/1994 |
| JP | 2010536007 | A | 11/2010 |
| JP | 2011033079 | A | 2/2011 |
| JP | 2018108851 | A | 7/2018 |
| KR | 20090078268 | A | 7/2009 |
| KR | 1020090078268 | A | 7/2009 |
| WO | 2014118821 | A1 | 8/2014 |
| WO | 2015063820 | A1 | 5/2015 |

* cited by examiner

THERMAL-INSULATION CONTAINER

CROSS-REFERENCE TO RELATED APPLICATIONS

This patent application claims priority to German utility patent application number 20 2019 105 348 filed Sep. 26, 2019 and titled "Thermal-Insulation Container". The subject matter of patent application number 20 2019 105 348 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

BACKGROUND

Thermal-insulation containers are receptacles for accommodating temperature-sensitive goods with an interior space which is separated from an exterior space in a thermally insulated fashion by means of thermally insulating walls.

Thermal-insulation containers of this generic type often exhibit the shape of a transport box in order to transport temperature-sensitive transport goods, such as foodstuffs or medication, at a controlled temperature.

Thermal-insulation containers are known, which are formed from a molded foam part, for example. In this case, the molded foam part is formed into a desired shape by foaming a foam material in a molding tool. For this purpose, the foaming material features thermal insulation properties. Thermal-insulation containers are known in the prior art from WO 2014/118 821 A1 and KR 10 2009 0 078 268 A.

Such thermal-insulation containers have the drawback that all walls have the same or a similarly high heat transfer coefficient. Hence, these thermal-insulation containers do not offer optimum thermal insulation properties, especially in those cases where the heat flux density of the external space acts anisotropically on the thermal-insulation container. In many applications, the heat flux density is particularly high in the region of the lid and the bottom. In regions of the thermally insulating walls of the thermal-insulation container where an increased heat flux density acts, the heat input into the thermal-insulation container is particularly high. Known thermal-insulation containers do not solve the problem of protecting specifically these regions of the thermal-insulation container from increased heat input.

SUMMARY

The present invention relates to a thermal-insulation container according to the independent claim.

It is the object of the invention to provide a thermal-insulation container which overcomes the drawbacks of prior art, whereby in particular a thermal-insulation container with optimized heat transfer coefficients of the respective thermally insulating walls is provided.

The object is achieved by the thermal-insulation container according to the independent claim. Advantageous embodiments constitute the subject-matter of the respective subclaims.

The invention encompasses a thermal-insulation container which comprises a bottom, at least one, preferably four side walls each arranged on the bottom and a lid or a cover part arranged on the side walls. The bottom, the four side walls and the lid thereby completely enclose an interior space. In this regard, the lid has a heat transfer coefficient $k_D$, the bottom has a heat transfer coefficient $k_B$ and each of the side walls has one of the heat transfer coefficients $k_{S1}$, $k_{S2}$, $k_{S3}$ or $k_{S4}$. Furthermore, $k_D$<minimum [$k_{S1}$, $k_{S2}$, $k_{S3}$, $k_{S4}$, $k_B$]. The particularly low heat transfer coefficient $k_D$ of the lid is chosen in such a way to protect against a particularly high heat flux density, which for example is caused by solar radiation acting on the lid. For example, surfaces with lower emission coefficients, thicker design or lower thermal conductivity can be used.

DETAILED DESCRIPTION

It is advantageous if $k_D<k_B<$minimum [$k_{S1}$, $k_{S2}$, $k_{S3}$, $k_{S4}$]. The low heat transfer coefficient $k_B$ of the bottom is chosen in such a way to protect against increased heat flux density caused, for example, by contact of the bottom with the ground on which the thermal-insulation container is placed.

A thermal-insulation container, where $k_D<0.8$ in particular 0.6*minimum [$k_{S1}$, $k_{S2}$, $k_{S3}$, $k_{S4}$, $k_B$], is particularly advantageous.

According to another advantageous aspect, the bottom, the four side walls and the lid each include at least one vacuum insulation panel. A vacuum insulation panel thereby has a thermal conductivity of less than 9 mW/mK, in particular less than 5 mW/mK, especially preferably less than 3.5 mW/mK.

It is preferred if the lid comprises at least two vacuum insulation panels, whereby the vacuum insulation panels are arranged stacked on top of each other. In this way, a lower heat transfer coefficient $k_D$ of the lid can be easily realized.

A thermal-insulation container, wherein the bottom, the four side walls and the lid are made of the same material, is also preferred. In this context, the lid is designed thicker than the bottom and each of the four side walls. As a result, a lower heat transfer coefficient $k_D$ of the lid can be realized in another simple way.

A thermal-insulation container comprising at least one pedestal, which is placed on the bottom, is especially preferred. The at least one pedestal is designed and arranged on the bottom in such a way that the bottom of the thermal-insulation container does not come into direct contact with the ground when the thermal-insulation container is placed on a ground. This reduces the heat flux over the bottom.

In the following, the invention will be explained in more detail using the examples shown in the attached drawings. Identical reference signs concern the same features in all figures.

Figure 1:
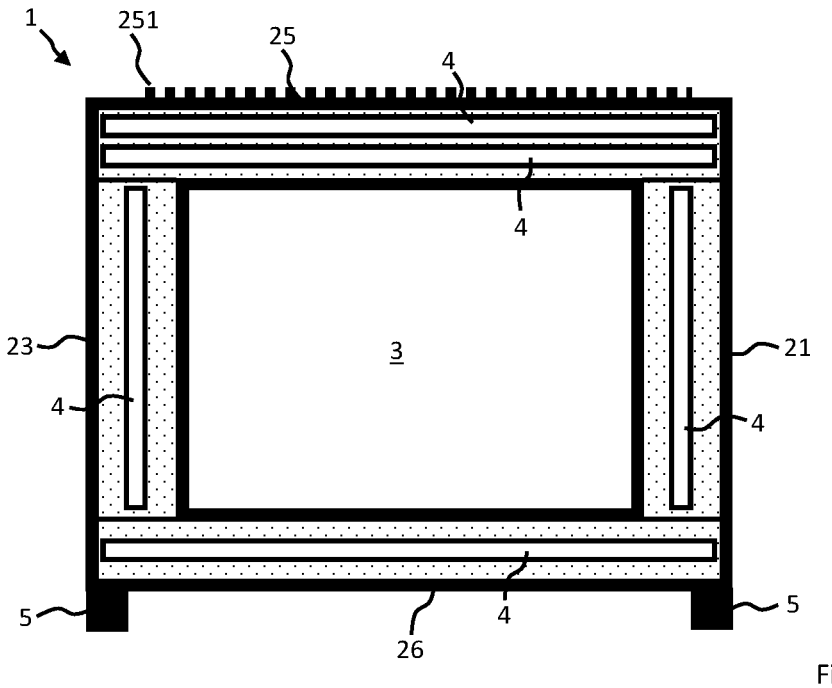
FIG. 1 shows a schematic sectional view of a first thermal-insulation container.
Figure 2:
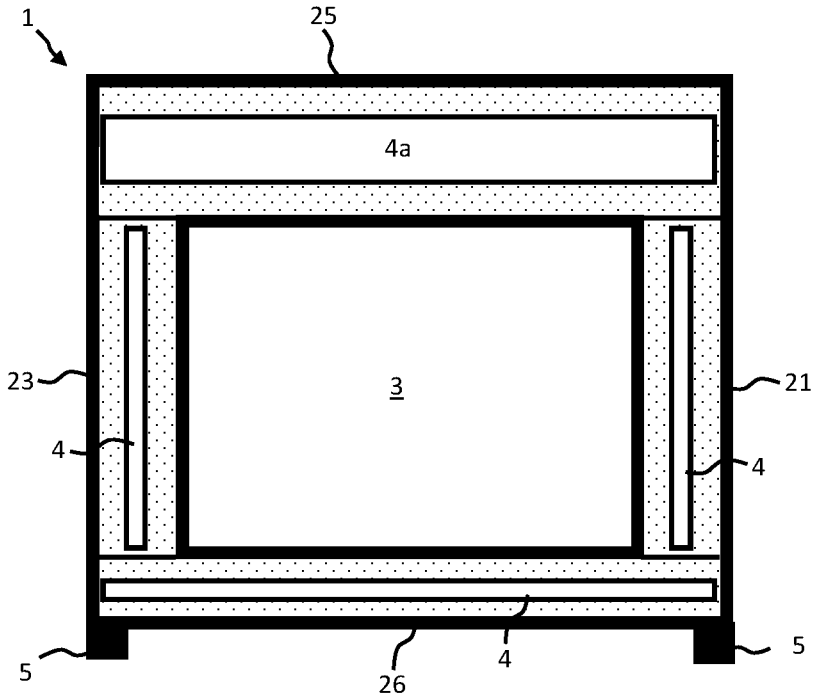
FIG. 2 shows a schematic sectional view of a second thermal-insulation container.

FIG. 1 and FIG. 2 show a thermal-insulation container 1, which comprises a bottom 26, four side walls 21, 23 [22, 24; the front and rear walls are not shown in this illustration] and a lid 25 arranged on the side walls. The bottom 26, the four side walls 21, 23 and the lid 25 thereby completely enclose an interior space 3.

In this context, the lid 25 has a heat transfer coefficient $k_D$=0.083 W/($m^2$*K), the bottom 26 has a heat transfer coefficient $k_B$=0.143 W/($m^2$*K), and each of the side walls 21, 23 has one of the heat transfer coefficients $k_{S1}=k_{S2}=k_{S3}=k_{S4}$=0.166 W/($m^2$*K).

Therefore, $k_D<k_B<$minimum [$k_{S1}$, $k_{S2}$, $k_{S3}$, $k_{S4}$] applies. The particularly low heat transfer coefficient $k_D$ of the lid 25 is chosen in such a way to protect against a particularly high heat flux density, which for example is caused by solar radiation acting on the top surface 251 of the lid 25. The low heat transfer coefficient $k_B$ of the bottom 26 is chosen in such a way to protect against an increased heat flux density which for example is caused by contact of the bottom 26 with the ground on which the thermal insulation container 1 is placed.

The shown thermal-insulation containers 1 comprise two pedestals 5, which are arranged at the bottom 26. The pedestals 5 reduce the heat flux over the bottom 26 when the thermal-insulation container 1 is placed on a ground, because the bottom 26 does not come into direct contact with the ground.

According to another advantageous aspect, the bottom 26, the four side walls 21, 23 and the lid 25 each comprise at least one vacuum insulation panel 4. While in FIG. 1 the lid 25 comprises two vacuum insulation panels 4 arranged stacked on top of each other, in FIG. 2 the lid 25 comprises a vacuum insulation panel 4*a* which is designed thicker than the vacuum insulation panels 4 of the bottom 26 and each of the four side walls 21, 23. In both inventive embodiments, an optimized heat transfer coefficient $k_D$ of the lid 25 can be easily realized in this way. Each of the vacuum insulation panels 4 shown thereby has a thermal conductivity of less than 9 mW/mK, in particular less than 5 mW/mK, especially preferably less than 3.5 mW/mK.

What is claimed is:

1. Thermal-insulation container, comprising a bottom, side walls arranged on the bottom and a lid arranged on the side walls, wherein the lid comprises at least two vacuum insulation panels, said vacuum insulation panels being arranged stacked on top of each other, wherein the bottom, the side walls and the lid completely enclose an interior space, and wherein the lid has a heat transfer coefficient $k_D$, the bottom has a heat transfer coefficient $k_B$, and each of the side walls has one of the heat transfer coefficients $k_{S1}$, $k_{S2}$, $k_{S3}$ or $k_{S4}$, and further $k_D<k_B<$minimum [$k_{S1}$, $k_{S2}$, $k_{S3}$, $k_{S4}$] and further comprising at least two pedestals coupled to the bottom such that the bottom does not directly contact a ground on which the container is placed.

2. Thermal-insulation container according to claim 1, wherein $k_D<0.8$ in particular 0.6*minimum [$k_{S1}$, $k_{S2}$, $k_{S3}$, $k_{S4}$, $k_B$].

3. Thermal-insulation container according to claim 1, wherein the bottom, the side walls and the lid each comprise at least one vacuum insulation panel.

4. Thermal-insulation container according to claim 1, wherein the bottom, the side walls and the lid are made of the same material or of different material, and wherein the lid is designed thicker than the bottom and each of the four side walls.

5. Thermal-insulation container according to claim 1, comprising at least two vacuum insulation panels with different heat transfer coefficients.

6. Thermal-insulation container according to claim 1, further comprising an additional insulation element.

7. Thermal-insulation container according to claim 6, wherein the additional insulation element is arranged in the bottom.

* * * * *